US007402017B2

(12) United States Patent
Stolzer

(10) Patent No.: US 7,402,017 B2
(45) Date of Patent: Jul. 22, 2008

(54) MECHANIZED SUPPORT FOR BOATS

(75) Inventor: Armin Stolzer, Nierstein (DE)

(73) Assignee: KEURO Besitz GmbH & Co. EDV-Dienstleistungs KG, Achern (DE)

( * ) Notice: Subject to any disclaimer, the term of this patent is extended or adjusted under 35 U.S.C. 154(b) by 0 days.

(21) Appl. No.: 11/331,526

(22) Filed: Jan. 13, 2006

(65) Prior Publication Data

US 2006/0182554 A1 Aug. 17, 2006

(30) Foreign Application Priority Data

Jan. 13, 2005 (EP) ..... 05000574

(51) Int. Cl.
*B65G 1/00* (2006.01)

(52) U.S. Cl. ..... 414/281

(58) Field of Classification Search ..... 114/44; 405/3; 414/266, 277, 279, 280, 281, 282, 414/283, 284
See application file for complete search history.

(56) References Cited

U.S. PATENT DOCUMENTS 6,007,288 A 12/1999 Maffett et al.
7,194,971 B2 * 3/2007 Stolzer ..... 114/44

FOREIGN PATENT DOCUMENTS

| | | | |
|---|---|---|---|
| DE | 2 233 198 | | 1/1974 |
| DE | 39 37 097 | | 5/1990 |
| DE | 100 45 677 | | 4/2002 |
| FR | 2 755 661 | | 5/1998 |
| JP | 2-183055 | * | 7/1990 |
| JP | 2-241891 | * | 9/1990 |

OTHER PUBLICATIONS

Translation of Japan 2-241891.*
Translation of Japan 2-183055.*

* cited by examiner

*Primary Examiner*—Sherman Basinger
(74) *Attorney, Agent, or Firm*—Volpe and Koenig, P.C.

(57) ABSTRACT

An arrangement is provided for dry storing boats (2) and holding them readily available, comprising a number of boat storage spaces (22) arranged at a waterfront area, and a lifting device (7) for lifting or pulling boats (2) from the water. The boat storage spaces (22) are formed according to the invention by a mechanized shelf or honeycomb storage facility (13) or the like, having fixed installed transportation devices (15, 19) for the storage and removal of boats (2). Preferably, cassettes (16) are provided, on which the boats (2) are stored and removed as well as transported.

28 Claims, 12 Drawing Sheets

MECHANIZED SUPPORT FOR BOATS

BACKGROUND

The invention relates to an arrangement for dry storage of boats which holds them readily available, having a number of boat storage spaces arranged at a waterfront area and with a lifting device for lifting or pulling boats off the water.

At waterfront areas and preferred coastal regions, due to the limited amount of space, there is frequently a lack of docking spaces for boats, in particular when they are also intended to keep boats readily available, either on land or along boat docks. The storage and ready availability of boats at the waterfront area, the term also including coastal regions, is therefore increasingly problematic.

Being relatively small water crafts, boats have traditionally been stored preferably dry and readily available, and therefore they were pulled onto shore. This frequently occurs via a rope winch, to which the boat is fastened, and by which the boat is pulled off the water and onto the shore. Conversely, the boat can then be returned to the water, if necessary, after a loading process.

Alternatively, boats are frequently stored on the water and held readily available, namely along a boat dock so that they can be loaded and entered therefrom. However, dry storage is naturally better for the life of the boat.

Due to the frequent lack of the above-mentioned boat docking spaces and/or storage spaces, increasingly boats are stored at buoys as an additional alternative without any direct access via a gangplank.

SUMMARY

The present invention is therefore based on the object to provide an arrangement for dry storing boats and holding them readily available, which allows, on a given area, a larger number of boats than previously thought possible to stored and held available.

This objective is attained in an arrangement having the features of the invention. Preferred further developments and embodiments of this arrangement are disclosed below.

Therefore, according to the present invention, boat storage spaces arranged at the waterfront area are formed by a mechanized shelf or honeycomb storage facility or the like, having transportation devices for loading and removing boats that are installed in a fixed manner. The invention is also based on the idea that storage techniques established in other fields, in particular in steel trading, for large and heavy objects that cannot be moved manually, may also be suitable for the storage and removal of boats. Boats are here lifted or pulled off the water by the lifting device, and subsequently they are placed by the transportation devices of the mechanized storage facility in a storage space, i.e. a shelf or a honeycomb of a honeycomb storage facility, in particular. Due to the fact that such a storage facility according to the invention allows several storage spaces to be arranged on top of one another and to establish the storage spaces at a certain distance from the shore, considerably more boats can be stored in a certain coastal area, and due to the mechanized transportation devices can also be kept readily available. Additionally, it is possible to cover the storage facility according to the invention with a roof or to arrange it inside a warehouse, which offers the great advantage that the boats are not subject to weathering and in particular to the UV-rays of the sun during the time they are stored and kept readily available. Additionally, a warehouse also provides improved protection from theft and vandalism.

Preferably, the transportation devices of the arrangement according to the invention serve not only for the immediate storage and removal of the boats into and out of the boat storage spaces, but also for the transportation of the boats between the boat storage spaces and the lifting device, so that an automatic operation of the storage facility from lifting the boat off the water to storing it in the storage facility and vice versa can occur.

For this purpose, the use of cassettes is particularly preferred here, on which the boats can be held for transportation and for storing and unloading. The cassettes are adjusted to the transportation devices and can therefore be easily pulled, pushed, and lifted, regardless of the shape and size of the boat supported on it.

To the extent said cassettes are also provided for lifting or pulling the boats off the water and, being adjusted to the lifting device for this purpose, a boat can automatically be put onto the cassette while still in the water, lifted off the water together with it, and stored by the transportation device in a boat storage space in the shelf or honeycomb storage facility or the like. Conversely, when needed, the transportation devices fetch the boat, stored on its cassette in the storage space, out of the storage facility and put it into the water, so that it can be used. Such cassettes are very advantageous in that boats of the most different dimensions and shapes up to a maximum size and a maximum weight can be transported as well as stored and removed, without having to design the transportation device and the boat storage spaces in a flexible manner to adjust them to the different shapes of the boats. Rather, the transportation devices and the boat storage spaces are merely to serve for the transportation and the acceptance of identical cassettes, while the cassette itself is adapted to the shape of the hull of the boat.

The cassettes can be provided with holding devices for latching support arms of lifting devices, and preferably they are provided with adjustable fasteners, in particular adjustable supports for adjusting to different boats. Then the boats merely need to be placed onto the cassettes, in order to be securely held when transported as well as stored or removed by them. Particularly when the boats are to be lifted or pulled off the water on the cassette this is very advantageous, because then the cassette merely needs to be brought underneath the floating boat and then be lifted in order to put the boat onto the cassette.

The cassettes according to this further development of the arrangement according to the invention can also be provided with driving wheels, to be activated, when needed, by which they then can be moved on land "manually" with or without a boat supported on them and be manipulated. This increases the flexibility of the arrangement.

Additionally, a number of cassettes can be provided, that are also adjusted to the transportation devices, however serve to hold at least one land vehicle each. This offers the advantage that, after the removal of the boat for the purpose of using it, the car by which the boat owner usually drives to the arrangement according to the invention, can be stored on a cassette in the boat storage space that has become available, and after the return of the boat it can again be removed for driving away. This way, the arrangement according to the invention is always used to optimized capacity, and the problematic amount of space required at conventional boat docks for the land vehicles of the boat owners, is advantageously minimized. Furthermore, during the absence of the owners a considerably increased protection from theft of the land vehicle results.

The transportation arrangements of the device according to the invention includes preferably a shelf operating device for storing and removing boats and a shifting car for transporting the boats between the lifting device and the shelf operating device. Here, the shelf operating device can be embodied in a manner known per se, for example, in the type of a shelf operating device for the storing and removing poles in honeycomb storage devices. Depending on the size of the arrangement according to the invention, several shelf paths can be provided with several shelf operating devices. Here, the shifting car has the purpose to drive to several shelf operating devices, when necessary, with it being beneficial if it can be moved perpendicularly in reference to the shelf paths. It is useful for a rotary device to be provided, by which the shifting car can be rotated around its vertical axis, which then allows an easy transfer of the pallet between the shifting car and the shelf operating device with or without a boat.

This preferably occurs such that the shifting car is provided with a device for pulling and pushing the cassette onto and off the shifting car, by which the cassette at the lifting device can be moved to a stand-by station or away from it as well as to a transfer location for the shelf operating device or away from it. The transfer location between the shelf operating device and the shifting car also serves as a buffer, because the shifting car can, after transferring a cassette to the transfer location, already perform the next task, even if the shelf operating system is not ready for accepting the cassette located on the transfer location, but is still performing another task. The same applies to the stand-by station between the lifting device and the shifting car.

The shifting car and the shelf operating device can run on rails, known per se, which facilitates a fully automated operation.

Further advantages result when, in addition to the storage device, the arrangement is also provided with a service station, accessible from all sides, which can be approached by the transportation device. Using the arrangement according to the invention it is then possible to lift a boat off the water via the lifting device and to drive it to the service station for maintenance. Alternatively, a boat stored in the storage facility can be removed and be driven to the service station or to a location for loading and/or unloading or to a gas station.

It is also advantageous for a loading station to be provided next to the storage facility for the land-side loading of a boat into the arrangement. In this loading station, a boat to be brought into the arrangement can be put onto a cassette, and then the cassette can be adjusted to the boat. The loading station is also an interface between the arrangement according to the invention and a vehicle for the transportation of a boat on land.

The lifting device of the arrangement according to the invention preferably comprises essentially a gantry crane with support elements for accepting one cassette each, and at the side facing the water, the cassette can be lowered below the water level and below the keel of the boat to be lifted, so that the boat can be moved over the cassette, and while on land the cassette can be put down on a stand-by station.

Particular advantages result here from the lifting device being provided with a centering device for centering a boat over a cassette lowered below the water level. This centering device may comprise sliders that can symmetrically approach the exterior hull of the boat from starboard and port-side and, if necessary, be complemented by a centering stop for the bow of the boat. Such a centering device ensures that the cassette merely needs to be raised in order to lift the boat, with the boat then automatically resting on the cassette correctly and centered and being lifted together with it by the arrangement according to the invention. This again is a measure allowing the fully-automated operation of the arrangement according to the invention, it desired.

The support elements of the lifting device may comprise a number of support arms connected to one another in order to form a lifting structure. The support arms are preferably pivotal to the outside, in order to also allow an automatic latching and unlatching of the cassette in and out of the respective fastening devices. The lifting device is preferably provided, at least at the water-facing side, with vertical guides for the lifting structure, with the parts of the lifting devices arranged facing the water preferably being embodied floating, in particularly such that they can be supported floating via pontoons guided in vertical guides. This measure ensures a secure and reliable operation of the lifting device even at varying water levels.

Further particular advantages result when the crane of the lifting device spans at least one road lane between its water-facing and its land-facing travel stops. This way it is possible for the storage facility according to the invention to be arranged, for example, behind a coastal road, and thus use areas for storing boats and holding them readily available that previously were not useable for this purpose.

The arrangement according to the invention is advantageously provided with a central control or control system for the transportation devices, with the central control allocating a certain boat to a certain cassette, and thus controlling the storage and removal process pursuant a specific boat. It is useful for this central control system also to control the lifting device, preferably such that upon request of a boat positioned in front of the lifting device it fetches the corresponding cassette, lowers it below the water level, lifts the cassette again after the boat has been moved and centered over it, until the boat rests thereupon, lifts the boat on the cassette off the water, optionally semi-automatically, transports it to the boat storage space, and stores it there. In order to remove the boat, this control process occurs in reverse.

Depending on the embodiment of the arrangement according to the invention, upon request, the central control process can either transport a certain boat to a service station or, after having fetched a boat from the boat storage space, storing a cassette with a land vehicle in said boat storage space and vice versa.

When loading a boat into the loading station, the central control advantageously identifies the boat, identifies the cassette, and allocates those two, so that this connection can be saved as a data set. This offers particular advantages in connection with a perhaps existing arrangement for an automatic identification of boats brought into the loading station of the arrangement, namely with regard to a fully-automated operation of the arrangement according to the invention. Because, when a boat in front of the lifting device has been recognized, automatically the corresponding cassette is fetched from storage and lowered in the lifting device below the water level. After the boat has moved into the lifting device, the cassette is lifted and the boat together with the cassette is transported to storage in the above-described manner and stored there.

BRIEF DESCRIPTION OF THE DRAWINGS

In the following, an exemplary embodiment of an arrangement according to the invention is explained in greater detail using the attached drawings. They show.

DETAILED DESCRIPTION OF THE PREFERRED EMBODIMENTS

Figure 1:
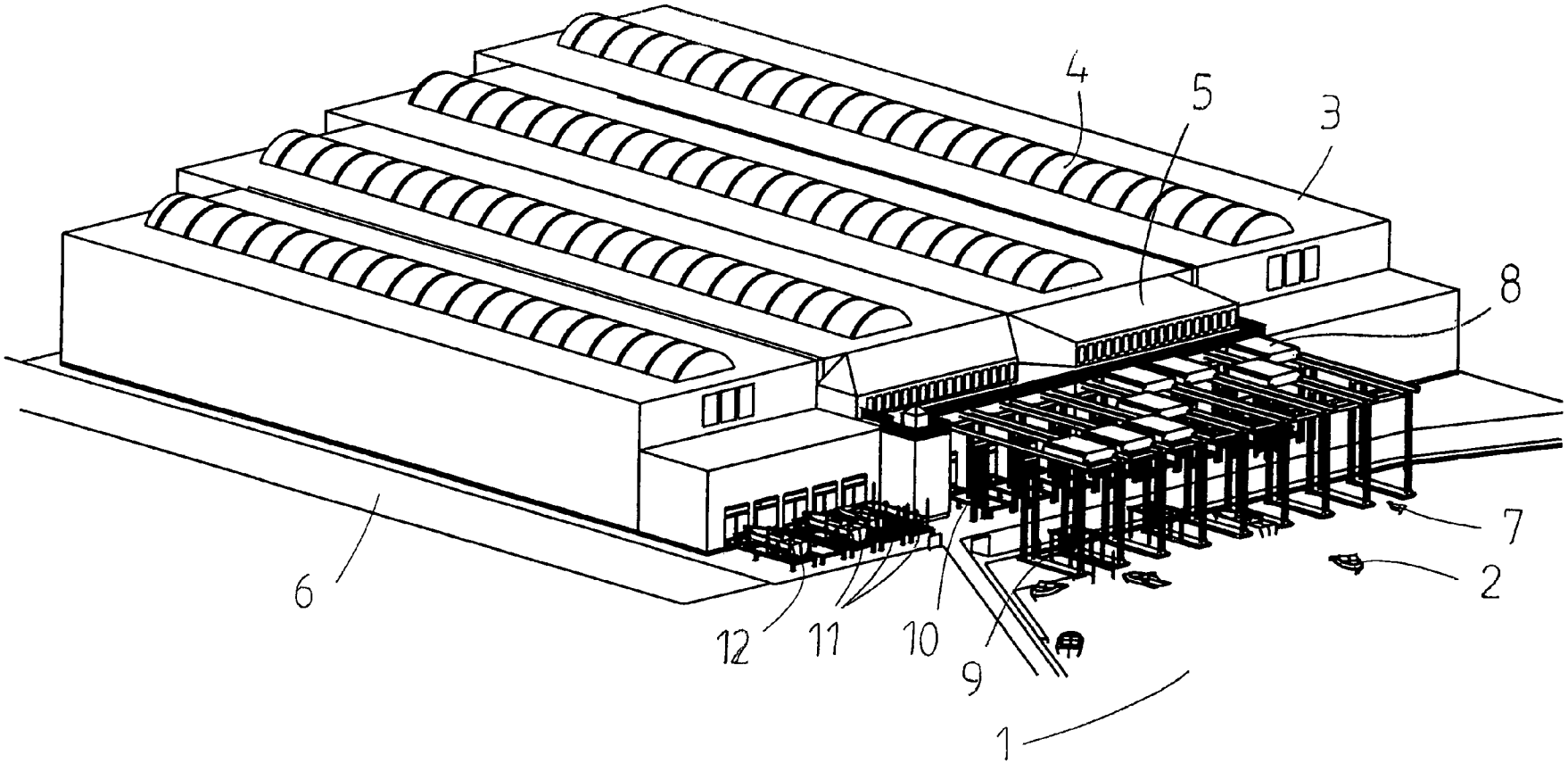
FIG. 1 a perspective overall view of an arrangement according to the invention.

The perspective overview of an arrangement according to the invention illustrated in FIG. 1 shows an inner harbor 1 with a number of boats 2 as well as a warehouse 3 with skylight devices 4 and restaurant facilities 5 next to a driveway 6. As an interface between the inner harbor 1 and the warehouse 3, a total of eight lifting devices 7 operate, in which one crane, embodied as a gantry crane 8 with a lifting structure 9, can move a cassette (not shown) with or without a boat between the inner harbor 1 and a stand-by station 10 at the entry of the warehouse 3. In addition to the lifting device 7, four service stations 11 are provided as well as a loading station 12 as an interface between the driveway 6 and the arrangement according to the invention.

Figure 2:
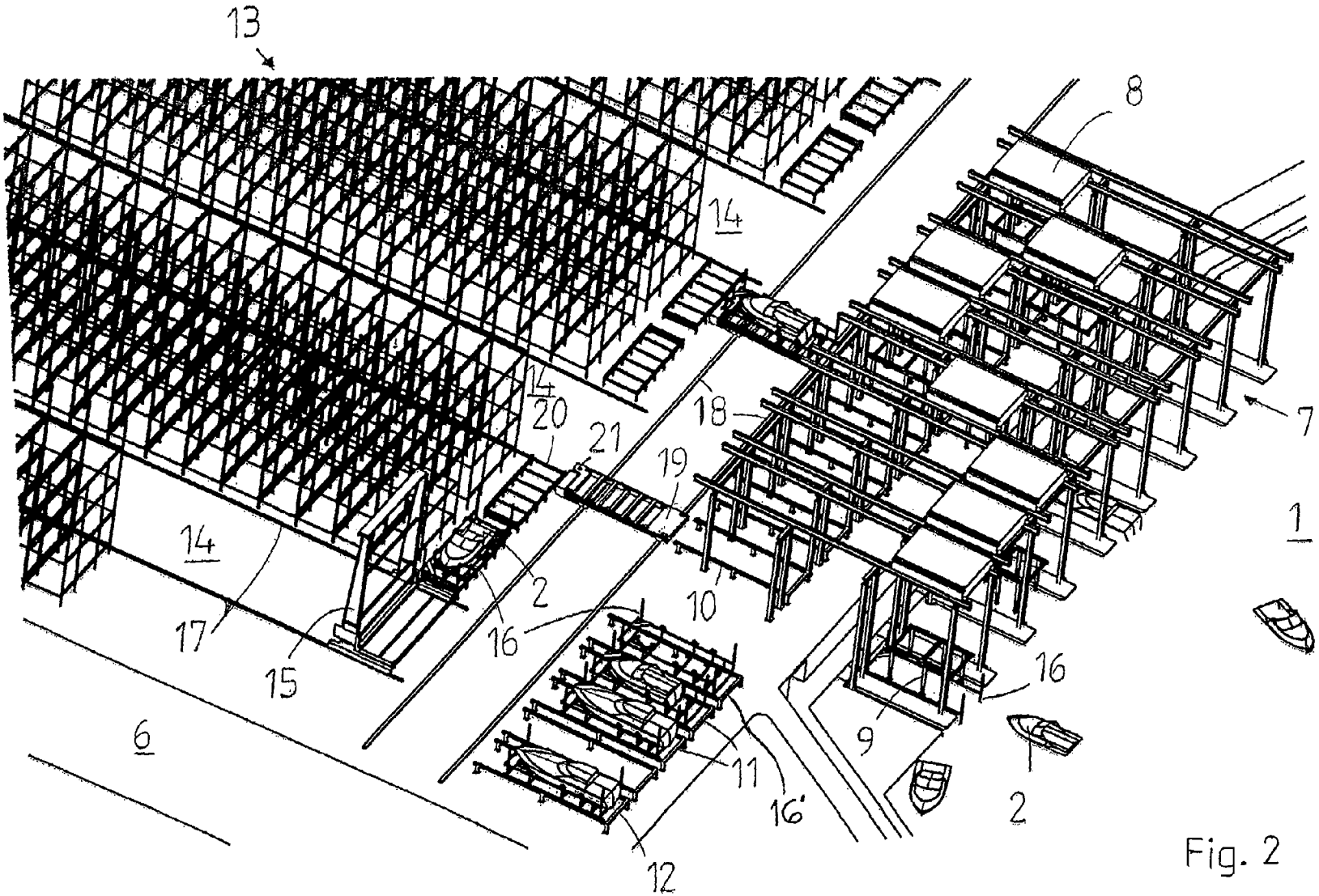
FIG. 2 a perspective top view with remote building parts.

In FIG. 2, the arrangement according to the invention is shown in a slightly larger scale and without the warehouse 3, however in a similar perspective as in FIG. 1. Here it is discernible that the present storage facility concerns a honeycomb storage facility 13 with several shelf paths 14, in which one shelf operating device 15 each, known per se, can be moved on rails 17 for storing and removing cassettes 16 with boats 2 supported thereupon into the individual honeycombs and removing them therefrom. In order to transport the boats 2 on their cassettes 16 between the stand-by station 10 of the lifting device 7 and the shelf operating device 15, shifting cars 19 running on rails 18 are provided, which can longitudinally pull the cassettes 16 off the stand-by station 10, with or without a boat, or push them onto it and can perpendicularly transfer the cassettes 16 to the transfer stations 20 at the beginning of each shelf path 14 or remove it therefrom, which transfer station 20 serves as an interface for the shelf operating device 15. For this purpose, the shifting car 19 is provided with a rotary device 21, by which it can be rotated by 90°, in order to perpendicularly move a cassette 16 onto the transfer station 20 or to remove it therefrom. One cassette 16' can be provided, that is also adjusted to the transportation devices, which serves to hold at least one land vehicle.

Figure 3:
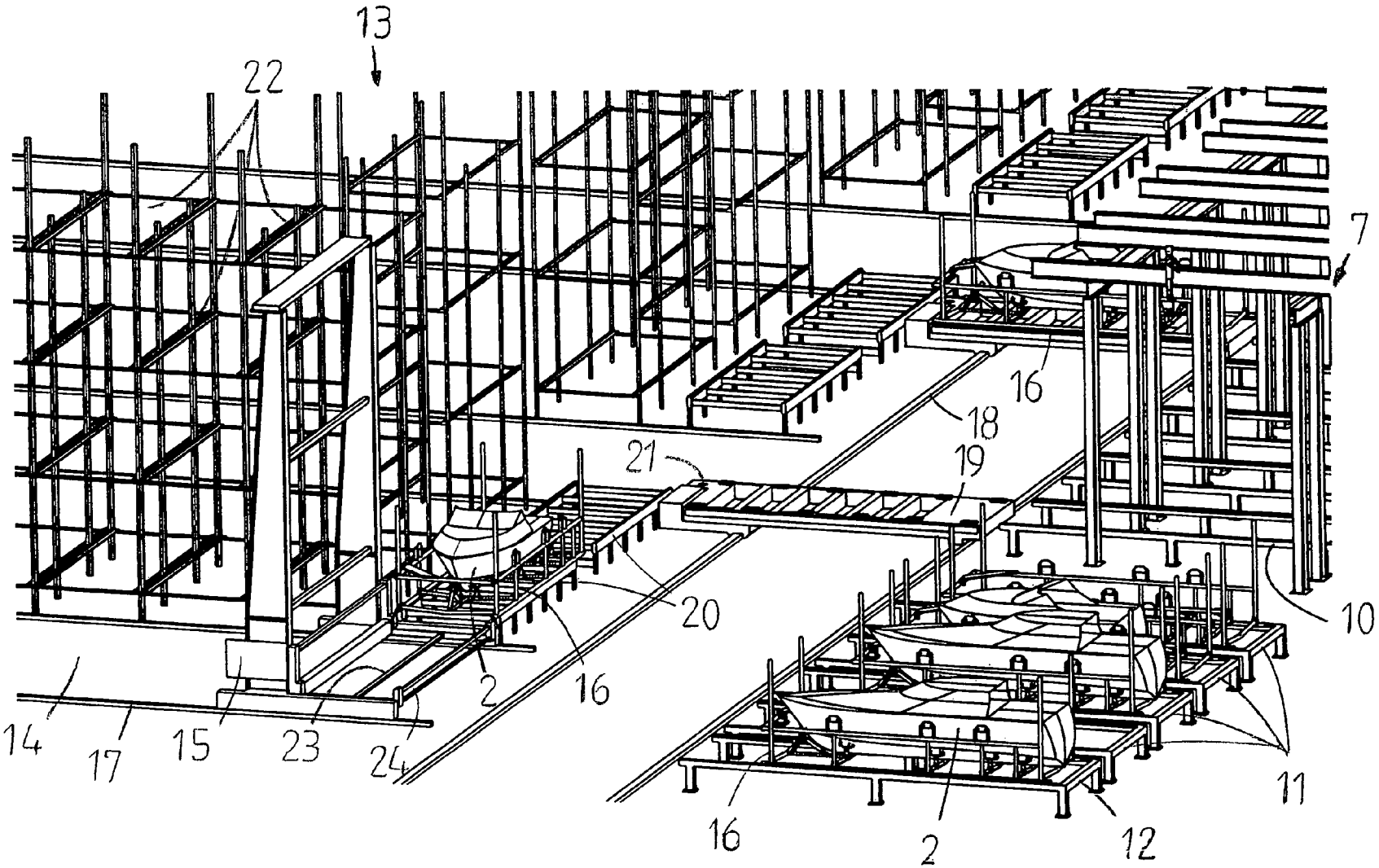
FIG. 3 a view according to FIG. 2, from a different perspective.

As better discernible in FIG. 3, four boat storage spaces 22, shown in the honeycomb storage 13, are each arranged on top of one another, and can be approached by the shelf operating device 15. A linear manipulator 23 pulls the cassette 16 positioned on the transfer station 20 together with the boat 2 onto the transportation structure 24 of the shelf operating device 15 and pushes it reversely when reaching the respective boat storage space 22 off the transportation structure 24 into said space. Removal of a boat 2 or an empty cassette 16 is carried out through reverse function.

As seen in FIGS. 2 and 3, the shifting cars 19 can each either put a cassette 16 onto a service station 11 located in the arrangement or fetch it therefrom. The same applies to the loading station 12.

Figure 4:
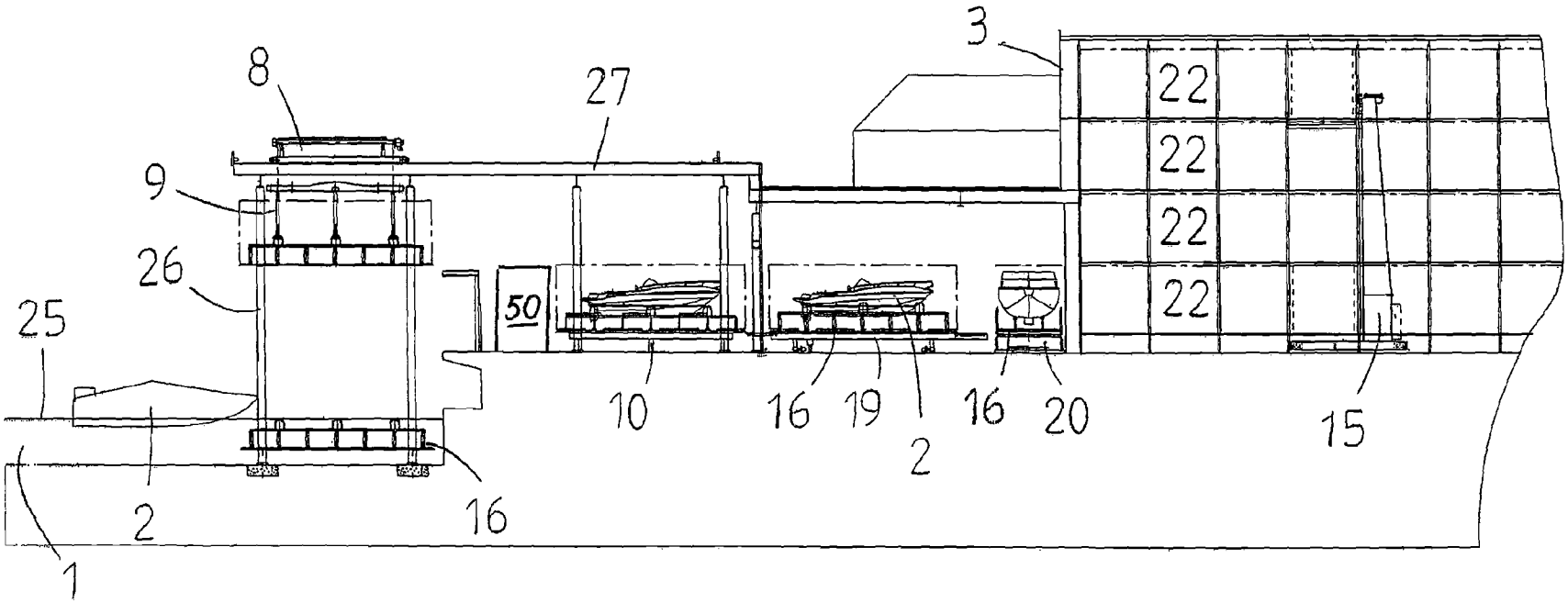
FIG. 4 a schematic side view.

In FIG. 4, the essential elements of the present exemplary embodiment of the arrangement according to the invention are shown once more schematically in a side view, with the process of storing a boat 2 from the inner harbor 1 being illustrated. The boat 2 is moved over a cassette 16, which has been lowered below the water level 25. Subsequently, the gantry crane 8 lifts the cassette 16 out of the water via its lifting structure 9 within vertical guides 26 and displaces it along a rail bridge 27 to the shore, where the cassette 16 is lowered onto the stand-by station 10. Then the shifting car 19 pulls the cassette 16 longitudinally off the stand-by station and displaces it perpendicularly to the desired shelf path, and subsequently a rotation of the shifting car 19 with the cassette 16 occurs by 90° and the cassette 16 is then pushed broadside onto the transfer station 20 of the respective shelf path. From the transfer station 20 the shelf operating device 15 accepts the cassette 16 with the boat 2, again in the longitudinal direction, lifts it and stores the boat 2 together with the cassette 16 longitudinally in a boat storage space 22 in the honeycomb storage facility 13. The control system 50 is also schematically illustrated.

Figure 5:
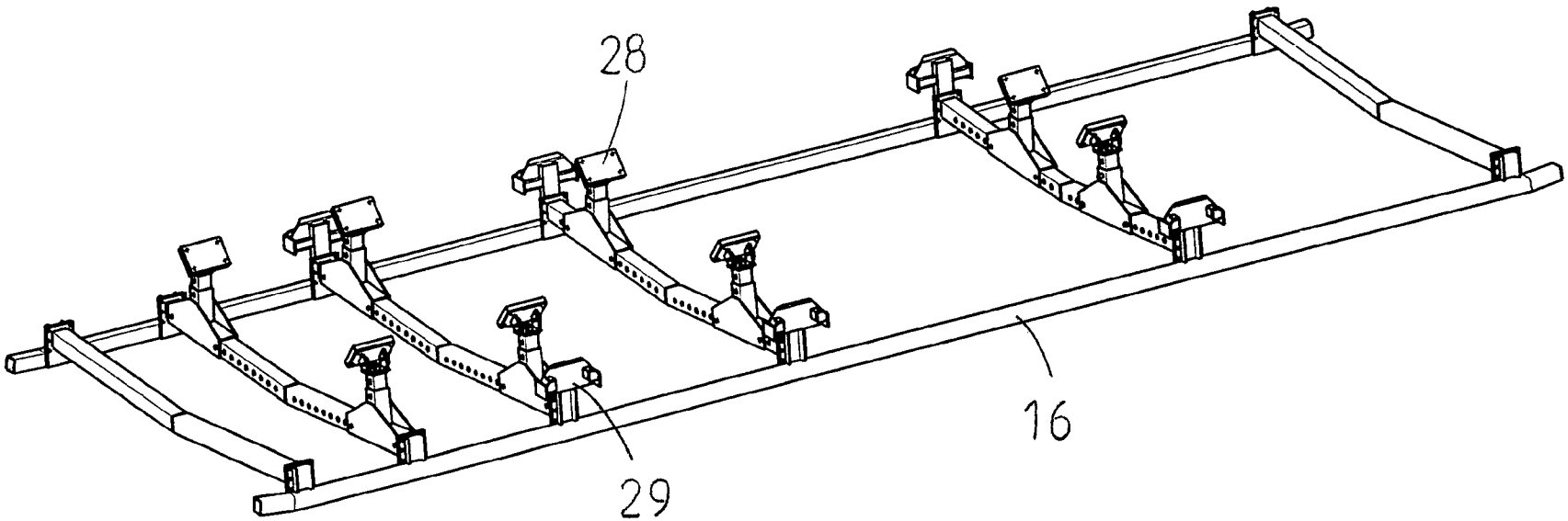
FIG. 5 a cassette in a perspective view.

In FIG. 5, a cassette 16 in a simple form is shown in perspective. It essentially comprises a pipe structure with adjustable supports 28 resting thereupon for the exterior hull of a boat. Laterally, fastening devices 29 are mounted, into which latches 30 of support elements 31 of the lifting device 7 can be latched, as shown in FIG. 9.

Figure 6:
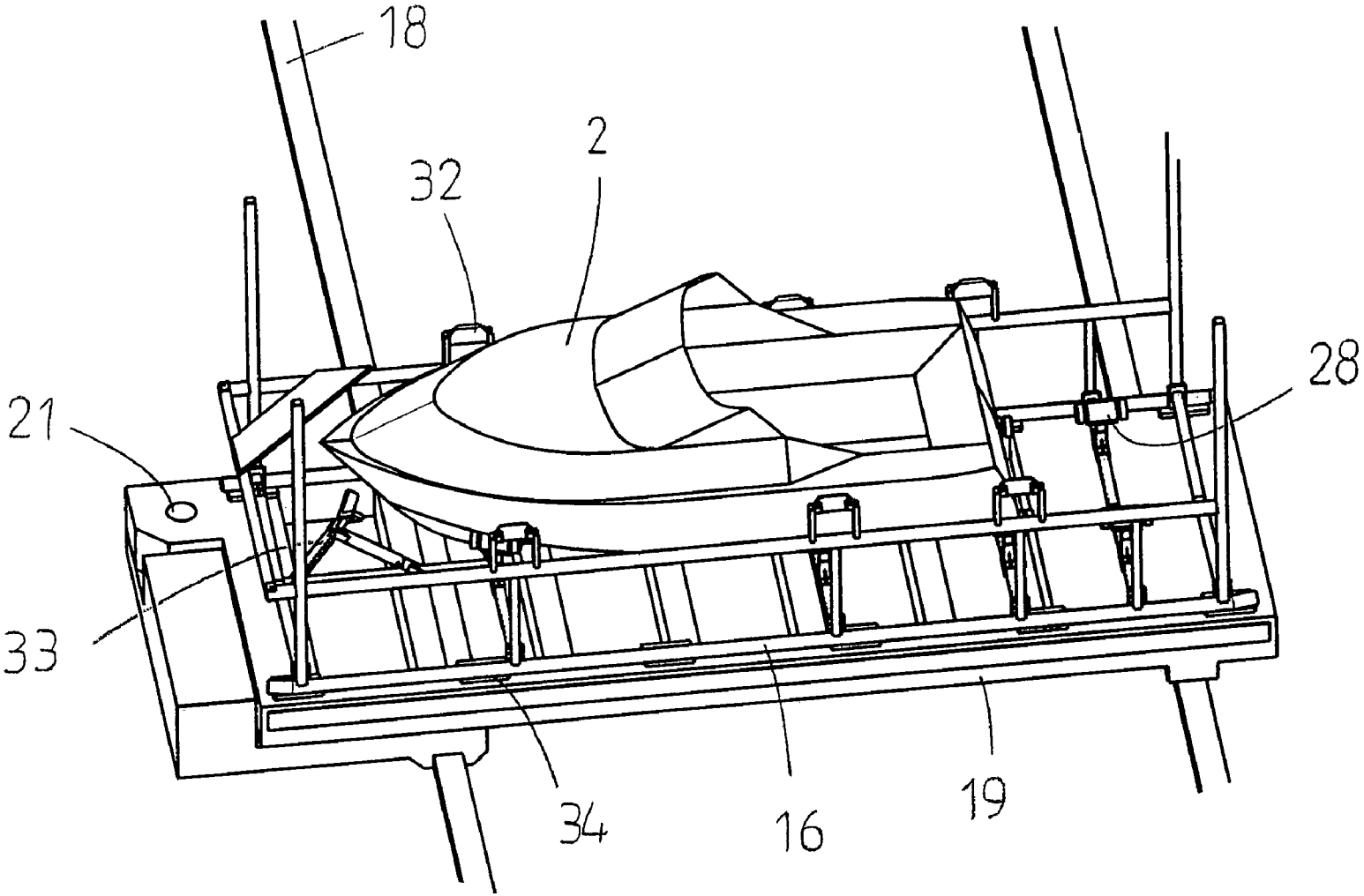
FIG. 6 a perspective view of a cassette on a shifting car, including a boat.

FIG. 6 shows a shifting car 19 with a cassette 16 resting thereupon, which again supports a boat 2. The cassette 16 shown here differs from the cassette 16 shown in FIG. 5 in that lateral tipping prevention devices 32 and a keel stopper 33 are provided. At the bottom of the cassette 16, slide elements 34 are provided for an easier pulling and pushing of the cassette 16 during the transfer to the stand-by stations and the transfer stations as well as the storage and removal.

Figure 7:
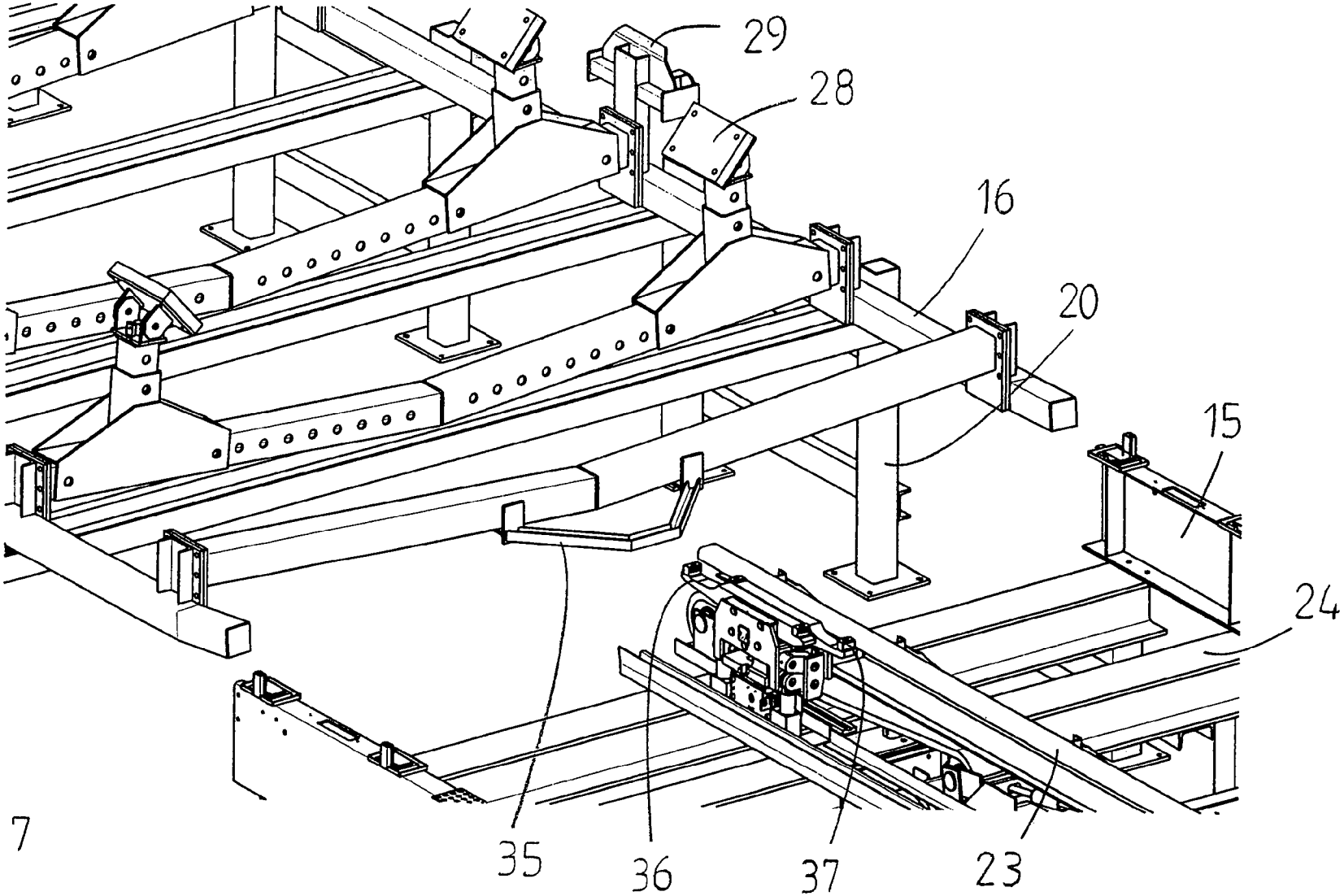
FIG. 7 a detailed view for the transfer of a cassette from a transfer station to a shelf operating device.

FIG. 7 shows a detail: at the front, the cassette 16 shown here is provided with a fastening device 35 for the manipulator 23 on the transportation structure 24 of the shelf operating device 15. Either a draw hook 35 or a slide hook 37 of the manipulator 23 engages in this holding device 35, in order to pull the cassette 16 off the transfer station 20 onto the transportation structure 24 of the shelf operating device 15 or, conversely, to push it onto the transfer station 20.

Figure 8:
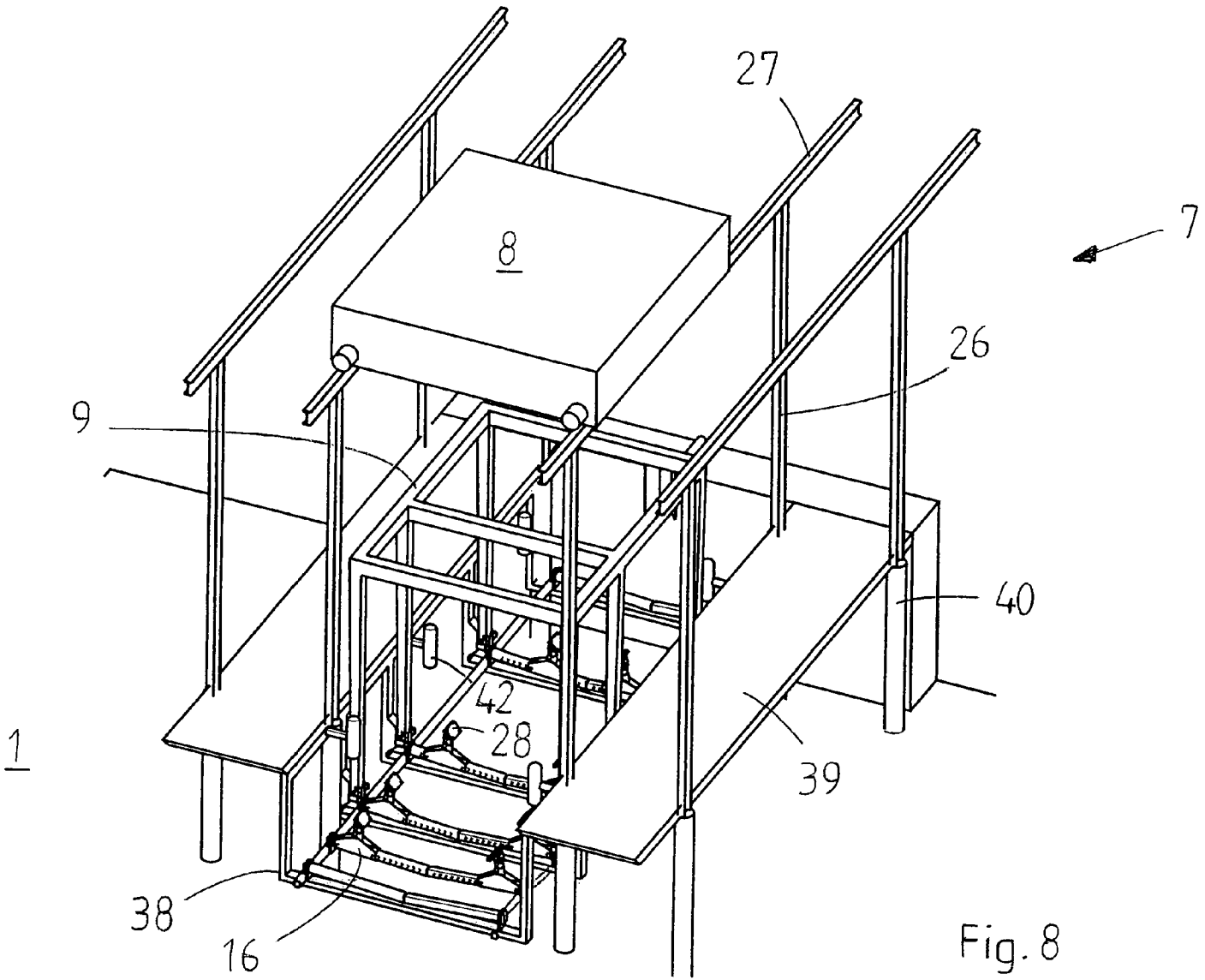
FIG. 8 a perspective view of a lifting device.
Figure 9:
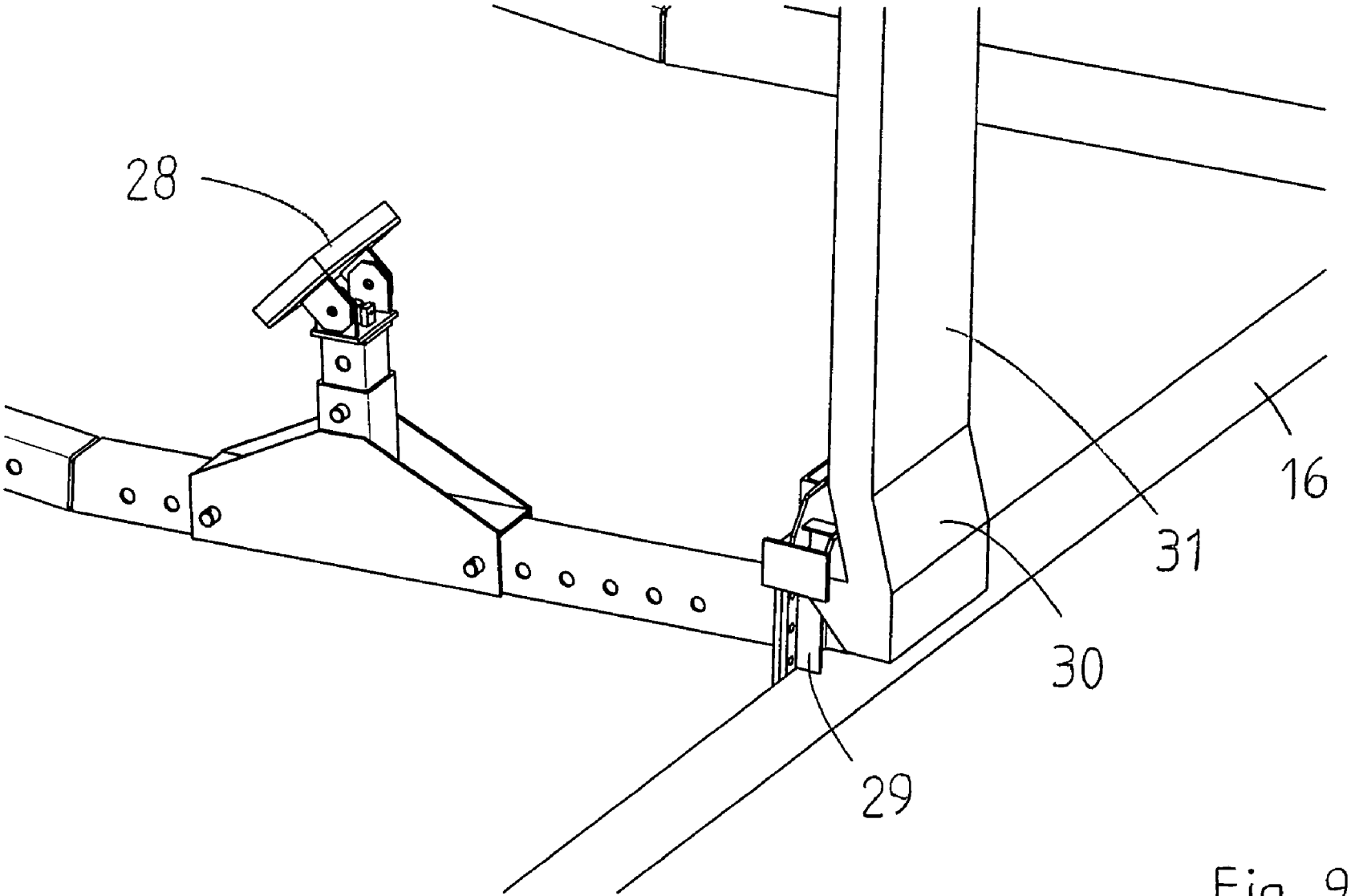
FIG. 9 a detail for fastening a cassette to the lifting device.
Figure 10:
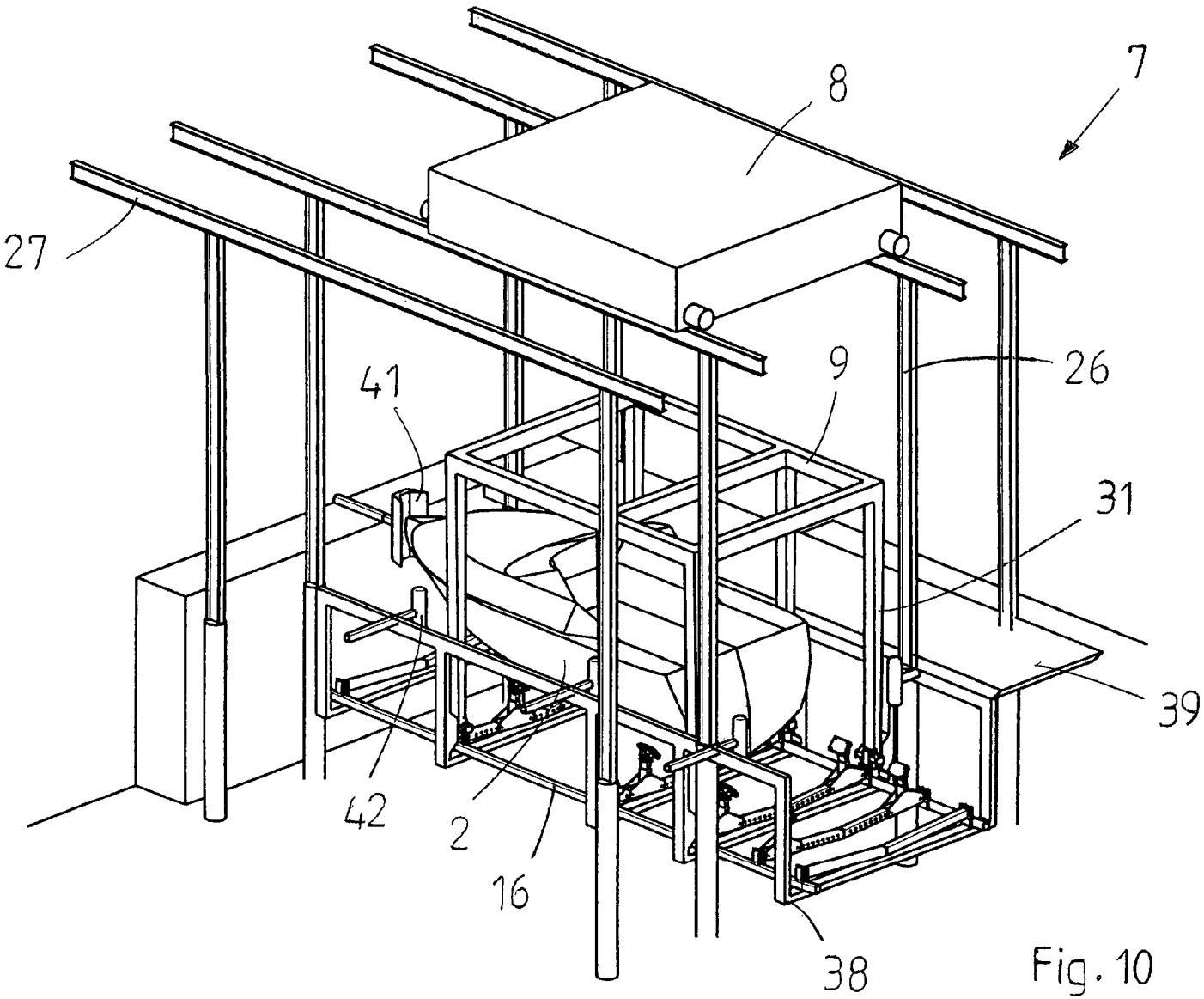
FIG. 10 the lifting device from FIG. 8 with a boat having entered.

In FIGS. 8 through 10, schematically a lifting device 7 of the exemplary embodiment of an arrangement according to the invention is shown. In FIG. 8, the gantry crane 8 has lowered the lifting structure 9 suspended therefrom and a cassette 16 located on it below the water level onto a lower stop 38. The lifting structure 9 comprises a total of six support elements 31, which are latched via links 30 in holding devices 29 of the cassette 16, as shown in FIG. 9. The stop 38 is connected to a gangplank 39, which gangplank serves as the access for a boat 2 that has moved (sailed) into the lifting device 7. The gangplank 39 and the stop 38 are supported floating at the vertical guides via pontoons 40, so that they adjust to the water level in the inner harbor 1. At the height of the gangplank 39, at the front, a centering stop 41 for the bow of the boat 2 is arranged (discernible in FIG. 10). Laterally, at the height of the gangplank, a number of sliders 42 are arranged, which can be shifted symmetrically towards the center of the lifting device 7 and in this manner center a boat 2 that has sailed into the lifting device 7 above the cassette 16. The boat 2 centered in this manner can then simply be placed fittingly onto the cassette by lifting the lifting structure 9, and then be put down on the stand-by station 10 (not shown here) by further lifting it by the gantry crane 8 and by traveling a rail bridge 27.

Figure 11:
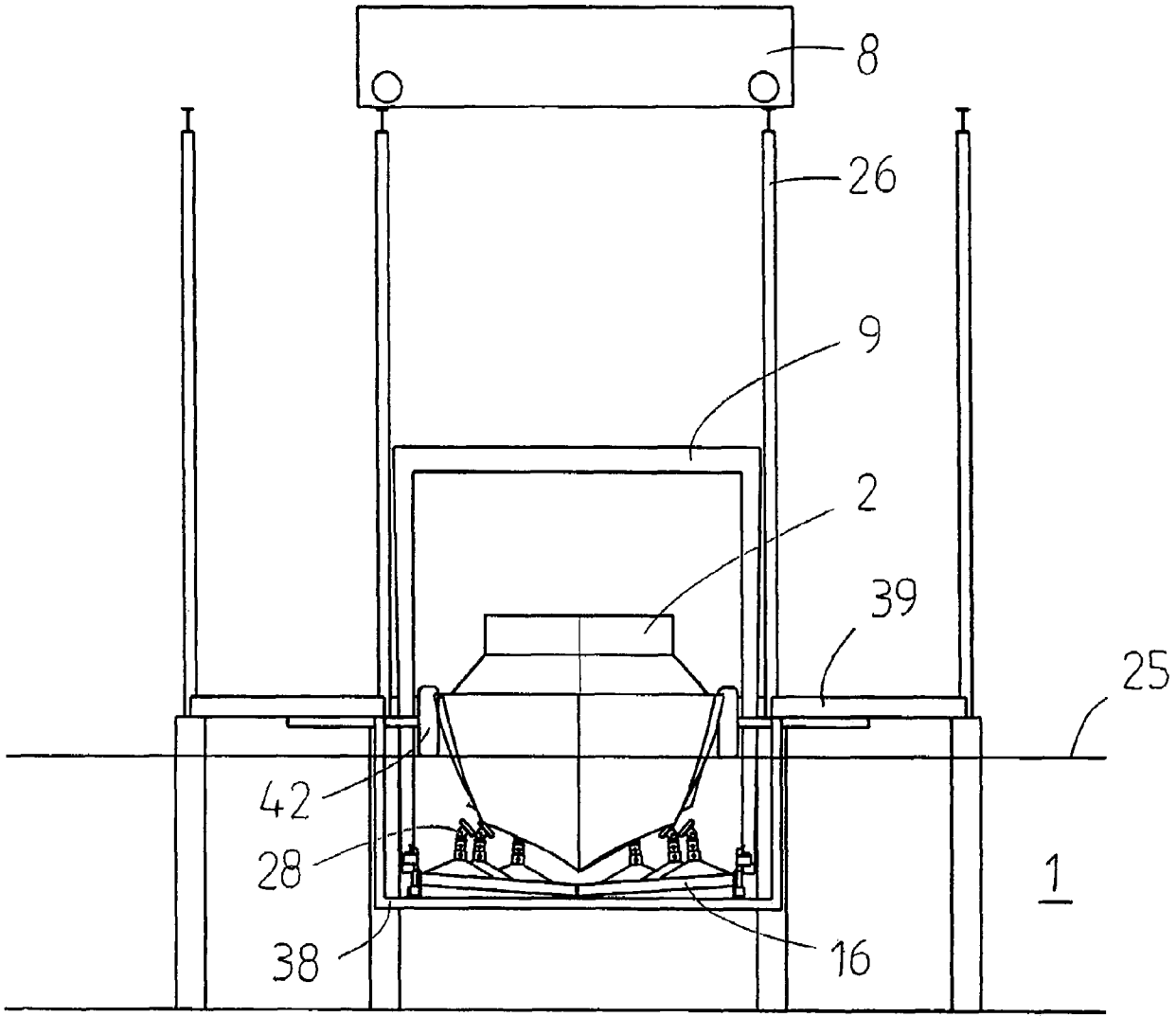
FIG. 11 a schematic frontal view of the centering of a boat in the lifting device.

In FIG. 11, another view of the above-described lifting device 7 seen from the side of the inner harbor is shown schematically, in order to illustrate the centering of the boat 2 by the sliders 42, which ultimately lead to a clean placement of the boat 2 on the supports 28 of the cassette 16 when lifting it via the lifting structure 9.

Figure 12:
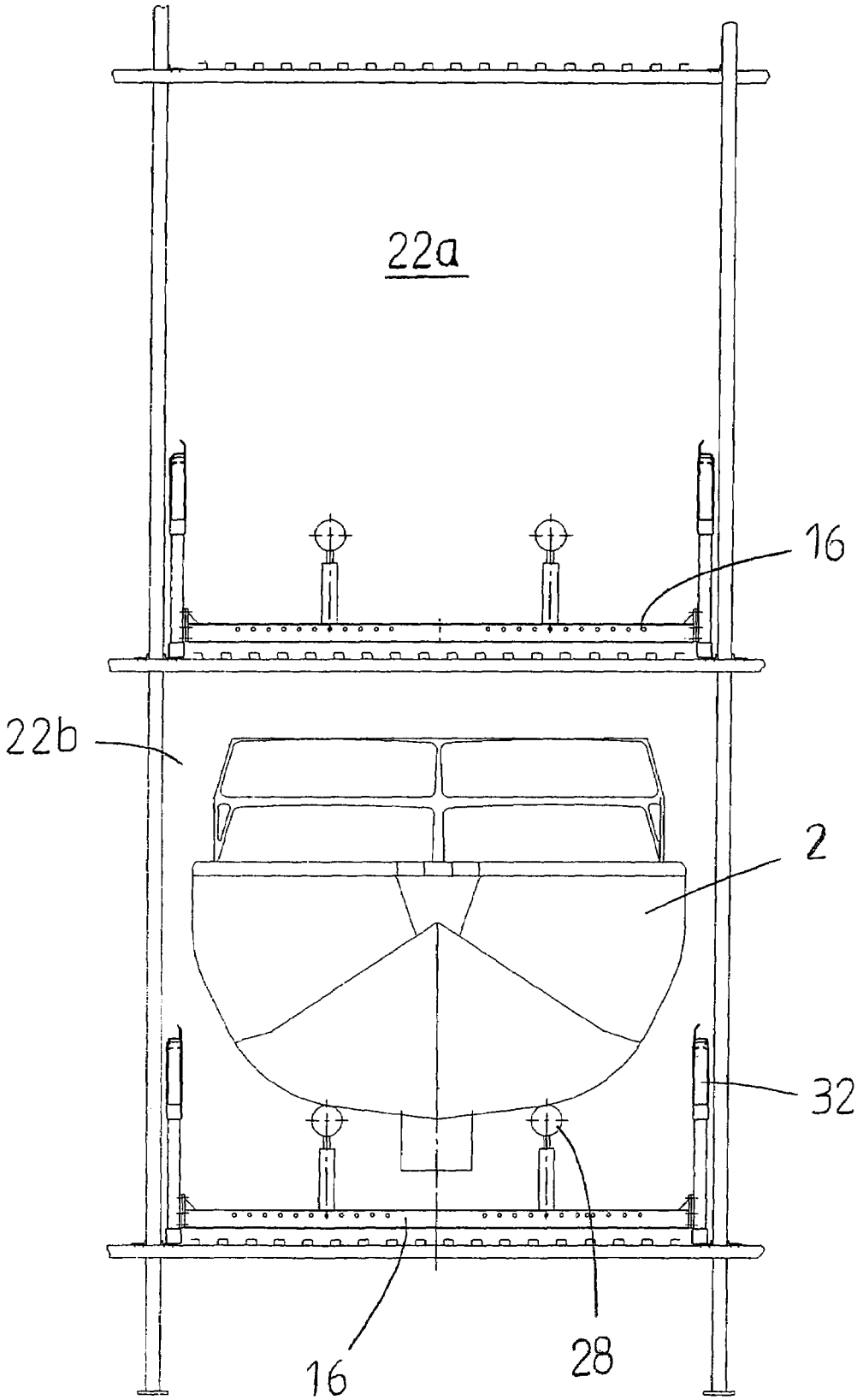
FIG. 12 a schematic frontal view of a boat stored on a cassette.

Finally, FIG. 12 shows schematically two boat storage spaces 22*a* and 22*b* as a part of a honeycomb storage facility 13 in a frontal view, with an empty cassette 16 being stored in the boat storage space 22*a*, while a cassette 16 with a boat 2 supported thereupon being discernible in the boat storage space 22*b*.

The present exemplary embodiment of the arrangement according to the invention is operated automatically by a central control or control system. For this purpose, a boat 2 is positioned on the loading station 12 for initialization, adjusted to a certain cassette 16, here, and this certain cassette 16 with the corresponding boat 2 is identified in the control system and saved correspondingly. Then the boat 2 with its cassette 16 is stored in a certain boat storage device 22 determined by the control via the shifting car 19 and a shelf operating device 15. It is not necessary for this boat storage space 22 to be fixed; it may be determined at random by a technology known per se by the control system in a chaos theory type storage facility, with it only be important that the storage always knows which boat 2 is stored in which storage space 22, and if necessary, where the cassette 16 allocated to said boat 2 is located, when the boat is to be stored again after use.

When the owner of a boat wants to sail into the inner harbor 1 with his/her stored boat 2, the control is activated accordingly, after which it preferably automatically fetches the specific boat from its boat storage space 22 by pulling the boat 2 on its cassette 16 out of the boat storage space 22 onto the transportation structure 24 by the corresponding shelf operating device 15, pushes it along a respective path from there to the transfer station 20, where a shifting car 19 accepts the cassette 16 with the boat 2 from the transfer station 20, rotates by 90°, moves it along rails 18 to a lifting device 7, and there the boat 2 with the cassette 16 is pushed onto the stand-by station 10. From the stand-by station 10 the gantry crane 8 removes the cassette 16 with the boat 2 by lowering the lifting structure 9 onto the cassette 16, latching the links 30 of the support elements 31 of the lifting structure 9 into the holding devices 29 of the cassette 16, and subsequently displacing the boat along the rail bridge 27 to the stop of the gantry crane 8 facing the water. Here, the cassette 16 is either partially automatically lowered to the stop 38, with the boat 2 floating on the water surface 25, and thereby being released from the cassette 16. Then, it can move/sail by its own power into the inner harbor 1. The boat owner has waited in the proximity of the gangplank 39 from there he/she and can enter his/her boat 2 in the lifting device 7.

Generally, after having sailed the boat 2 out of the lifting device 7, the cassette 16 is returned in the reverse direction back into the honeycomb storage 13, with the cassette 16 then being stored in a fixed boat storage space 22, if predetermined, although this is not necessary, as long as the control remembers where the cassette 16 has been put.

Upon the return of the boat 2, it is automatically identified by the control or the boat owner identifies himself/herself at a control interface with the control itself, so that then the corresponding cassette 16 can be fetched from the honeycomb storage 13 and again be lowered at the waterside of the lifting device 7 below the water level 26 and particularly lower than the keel of the boat 2. The boat 2 is then moved/sailed over the cassette 16 and centered exactly over the cassette 16 after the captain left via the gangplank 39 and the centering device has been activated via the sliders 42. Subsequently, the cassette 16 is lifted by the gantry crane 8 and stored in the boat storage space 22 in the honeycomb storage facility 13 in the reverse sequence as described above.

For maintenance purposes, the control can also be instructed to fetch a certain boat 2 from the honeycomb storage facility 13 and to put it to a service station 11.

LIST OF REFERENCE CHARACTERS

1 inner harbor
2 boat
3 warehouse
4 skylight device
5 restaurant facility
6 driveway
7 lifting device
8 gantry crane
9 lifting structure
10 stand-by station
11 service station
12 loading station
13 honeycomb storage facility
14 shelf path
15 shelf operating device
16 cassette
17 rails
18 rails
19 shifting car
20 transfer station
21 rotary device
22 boat storage space
23 manipulator
24 transportation structure
25 water level
26 vertical guide
27 rail bridge
28 support
29 holding device
30 latch
31 support element
32 tipping prevention device
33 keel stop
34 slide element
35 holding device
36 draw hook
37 slide hook
38 stop
39 gangplank
40 pontoon
41 centering stop
42 slider

The invention claimed is:

1. An arrangement for dry storing boats and holding them readily available, comprising a number of boat storage spaces (22) being arranged at a waterside, and a lifting device (7) for lifting or pulling boats (2) from the water, wherein the boat storage spaces (22) are formed by a mechanized shelf or honeycomb storage facility (13) with fixed installed transportation devices (15,17, 18, 19) for storing and removing the boats (2), cassettes (16) are provided adjusted to the transportation devices (15, 19) with each of the cassettes (16) adapted to hold one boat (2), the boats (2) can be placed on and removed from the cassettes as well as transported thereon, the lifting device (7) comprises a crane (8) with support elements (31) for accepting one of the cassettes (16), with the cassette (16) facing the water being lowerable below a water level (25) and below a keel of the boat (2) to be lifted, so that the boat (2) can move over the cassette (2), and the cassette (16) can be placed onto a stand-by station (10) on land, the support elements (31) comprise a number of support arms connected to one another to form a lifting structure (9), and the support arms are latchable with and unlatchable from respective fastening devices (29) of the cassettes (16) and are outwardly pivotable.

2. An arrangement according to claim 1, wherein the lifting device (7) is at least at a side facing the water provided with a vertical guide (26) for the lifting structure (9).

3. An arrangement according to claim 2, wherein parts of the lifting device (7) arranged facing the water are provided as floating except for at least one of the supports of the crane (8) and the vertical guides (26).

4. An arrangement according to claim 1, wherein the lifting device (7) at the side facing the water is at least partially surrounded by a gangplank (39), the gangplank (39) being provided in particular with bridge elements that are expandable telescopically or fan-wise for approaching the boat (2) centered in the lifting device (7).

5. An arrangement for dry storing boats and holding them readily available, comprising a number of boat storage spaces (22) being arranged at a waterside, and a lifting device (7) for lifting or pulling boats (2) from the water, wherein the boat storage spaces (22) are formed by a mechanized shelf or honeycomb storage facility (13) with fixed installed transportation devices (15,17, 18, 19) for storing and removing the boats (2), cassettes (16) are provided adjusted to the transportation devices (15, 19) with each of the cassettes (16) adapted to hold one boat (2), the boats (2) can be placed on and removed from the cassettes as well as transported thereon, the lifting device (7) comprises a crane (8) with support elements (31) for accepting one of the cassettes (16), with the cassette (16) facing the water being lowerable below a water level (25) and below a keel of the boat (2) to be lifted, so that the boat (2) can move over the cassette (2), and the cassette (16) can be placed onto a stand-by station (10) on land, the support elements (31) comprise a number of support arms connected to one another to form a lifting structure (9), the lifting device (7) is at least at a side facing the water provided with a vertical guide (26) for the lifting structure (9), and parts of the lifting device (7) facing the water are supported floating by pontoons (40) that are guided at the vertical guides (26).

6. An arrangement according to claim 1, wherein the crane (8) of the lifting device (7) spans at least one street width between a motion stop at the water and a stop on land.

7. An arrangement according to claim 1, wherein a central control system for the transportation devices (15, 19) is provided, which is embodied such that it allocates a specific one of the boats (2) to a specific boat storage space (22) and a specific cassette (16) and accordingly controls the storage and removal process in a boat-specific manner.

8. An arrangement according to claim 7, wherein the central control system also controls the lifting device (7).

9. An arrangement according to claim 8, wherein the central control system is provided such that it retrieves upon request the cassette of a boat positioned in front of the lifting device (7), lowers it below the water level (25), raises the cassette (16) again after the boat (2) has entered it and has been centered until the boat (2) rests upon the cassette, lifts the boat (2) on the cassette (16) from the water, transports the boat on the cassette to the boat storage space (22), and stores the boat and the cassette there, and vice versa.

10. An arrangement according to claim 9, wherein the central control system is provided such that it identifies the boat (2) when placing the boat (2) onto the cassette (16) in the loading station (12), allocates the boat to the cassette (16), and saves the allocation as a data set.

11. An arrangement according to claim 10, wherein a device for an automatic identification is provided for the boats (2) entering the arrangement via the loading station (12).

12. An arrangement according to claim 1, wherein there are a plurality of the lifting devices (7), and the transportation devices comprise a shelf operating device (15) for storing and removing boats (2) and a shifting car (19) for transporting boats between the lifting devices (7) and the shelf operating system (15), wherein the shifting car (19) is moveable between any of the plurality of lifting devices (7) and the shelf operating system.

13. An arrangement according to claim 1, wherein the cassettes (16) are additionally provided for lifting or pulling the boats (2) from the water and are adjusted to the lifting device (7).

14. An arrangement according to claim 1, wherein the cassettes (16) are provided with adjustable supports (28, 33) for adjustment to different ones of the boats (2).

15. An arrangement according to claim 1, wherein a number of the cassettes (16) adjusted to the transportation devices (15, 19) are provided with supports for at least one land vehicle, on which land vehicles can be stored and removed as well as transported.

16. An arrangement according to claim 1, wherein next to the storage facility (13) at least one service station (11) accessible from all sides and/or a loading station (12) for land-side loading of a boat (2) into the arrangement is provided, with the transportation devices (19) also being provided for transporting the boats (2) to and from the service station (11) and/or the loading station.

17. An arrangement according to claim 16, wherein the loading station (12) is embodied such that only one of the boats (2) is supported on each of the cassettes (16) and the cassettes (16) can be adjusted to the boat (2) in the loading station (12).

18. An arrangement according to claim 1, wherein the lifting device (7) is provided with a centering device (41, 42) for centering the boat (2), while the cassette (16) is below the water level (25).

19. An arrangement according to claim 18, wherein the centering device comprises sliders (42) adapted to symmetrically approach an exterior hull of the boat (2) from starboard and port-sides and/or a centering stop (41) for a bow of the boat (2).

20. An arrangement according to claim 5, wherein the transportation devices comprise a shelf operating device (15) for storing and removing boats (2) and a shifting car (19) which receives and transports boats located on the cassettes between the lifting device (7) and the shelf operating system (15).

21. An arrangement according to claim 5, wherein the cassettes (16) additionally are provided for lifting or pulling the boats (2) from the water and are adjusted to the lifting device (7).

22. An arrangement according to claim 21, wherein the cassettes (16) are provided with holding devices (29) for latching to support elements (31) of the lifting device (7).

23. An arrangement according to claim 5, wherein the cassettes (16) are provided with adjustable supports (28, 33) for adjustment to different ones of the boats (2).

24. An arrangement according to claim 5, wherein a number of the cassettes (16) adjusted to the transportation devices (15, 19) are provided with supports for at least one land vehicle, on which land vehicles can be stored and removed as well as transported.

25. An arrangement according to claim 5, wherein next to the storage facility (13) at least one service station (11) accessible from all sides and/or a loading station (12) for land-side loading of a boat (2) into the arrangement is provided, with the transportation devices (19) also being provided for transporting the boats (2) to and from the service station (11) and/or the loading station (12).

26. An arrangement according to claim 25, wherein the loading station (12) is embodied such that only one of the boats (2) is supported on each of the cassettes (16) and the cassettes (16) can be adjusted to the boat (2) in the loading station (12).

27. An arrangement according to claim 5, wherein the lifting device (7) is provided with a centering device (41, 42) for centering the boat (2), while the cassette (16) is below the water level (25).

28. An arrangement according to claim 27, wherein the centering device comprises sliders (42) adapted to symmetrically approach an exterior hull of the boat (2) from starboard and port-sides and/or a centering stop (41) for a bow of the boat (2).

* * * * *